United States Patent [19]

Hell et al.

[11] 4,115,981

[45] Sep. 26, 1978

[54] APPARATUS FOR ASSEMBLING AND PACKING PHOTOGRAPHIC PRINTS WITH ASSOCIATED DEVELOPED FILMS

[75] Inventors: August Hell, Feldkirchen; Wolfram Kobusch, Vaterstetten; Fritz Braun, Munich, all of Fed. Rep. of Germany

[73] Assignee: AGFA-Gevaert, A.G., Leverkusen, Fed. Rep. of Germany

[21] Appl. No.: 804,393

[22] Filed: Jun. 7, 1977

[30] Foreign Application Priority Data

Jun. 12, 1976 [DE] Fed. Rep. of Germany ..... 2626448

[51] Int. Cl.[2] ..... B65B 57/08; B65B 57/16

[52] U.S. Cl. ..... 53/55; 53/493; 53/520; 53/131; 53/137

[58] Field of Search ..... 53/55, 59 R, 123, 131, 53/137, 159, 183

[56] References Cited

U.S. PATENT DOCUMENTS

| | | | |
|---|---|---|---|
| 3,751,874 | 8/1973 | Schultes et al. | 53/59 R |
| 3,857,220 | 12/1974 | Schneider et al. | 53/59 R |

*Primary Examiner*—Travis S. McGehee
*Attorney, Agent, or Firm*—Peter K. Kontler

[57] ABSTRACT

Apparatus for collating prints and related sections of developed photographic customer films in a processing laboratory has a first conveyor whose receptacles advance stepwise into register with discharge ends of feeding devices for film sections and prints, and a packing unit with a second conveyor which advances empty containers past an assembly station where the containers receive assemblies of film sections and related prints in response to forward strokes of a reciprocable pusher. The second conveyor advances successive loaded containers past a closing device and a labelling device and thereupon into a receiving device. A computer receives signals from the severing mechanisms of the two feeding devices and from a reader which decodes information on envelopes used by customers or dealers to deliver or send exposed customer films to the laboratory. The computer transmits signals to a label printer and to an evaluating circuit whose board displays signals denoting errors detected by the computer and/or malfunctioning of one or more parts of the apparatus.

37 Claims, 2 Drawing Figures

APPARATUS FOR ASSEMBLING AND PACKING PHOTOGRAPHIC PRINTS WITH ASSOCIATED DEVELOPED FILMS

BACKGROUND OF THE INVENTION

The present invention relates to apparatus for processing customer films and prints in photographic processing laboratories. More particularly, the invention relates to apparatus for automatic processing of films, prints and containers and for introduction of films and associated prints into the corresponding containers so that the resulting packages are ready to be picked up by or delivered or shipped to dealers or customers.

It is known to subdivide exposed and developed customer films into sections of preselected length (each such section may consist of four, five or six film frames), to subdivide a web of exposed and developed photographic paper into prints, and to assemble the prints with corresponding film sections. The web of exposed and developed photographic paper and the films are provided with indicia which are detected by monitoring devices serving to transmit signals which regulate the operation of devices which sever the web and the films as well as to furnish signals denoting the last print of a customer order. As a rule, the web is exposed to light in an automatic copying machine which receives signals indicating the optimum adjustment of exposure controls for the reproduction of images on successive film frames and the number of prints to be made of each image. The operation of a modern copying machine is automated to such an extent that the machine can turn out large numbers of prints per unit of time and requires little or no supervision. As a rule, several exposed but undeveloped customer films are spliced together end-to-end to form a long strip which is caused to pass through a developing machine. The strip is thereupon transported through the copying machine in synchronism with a web of photographic paper and the machine exposes successive frames of films forming the strip onto successive fields of the paper web. During copying, the rear side of the web is provided with indicia (e.g., in the form of dark spots) which identify the corresponding prints. After the web has been caused to pass through a developing machine, the indicia are decoded by a detector serving to control the operation of the severing device which subdivides the web into discrete prints by severing the web midway across the frame lines between neighboring prints. The strip of spliced-together films is subdivided into shorter strips or sections in a similar way subsequent to transport through the copying machine and, if necessary, for renewed transport through such machine for the making of prints with a different setting of exposure controls if the originally prepared prints are unsatisfactory. The sections of customer films are thereupon assembled in flat pockets.

The next stage of processing includes assembling the film sections with the corresponding prints and calculating the cost of completion of the customer order. The calculation depends on the total number and size of prints. This stage of processing, as well as the stage of assembling the film sections with corresponding prints, takes up much more time than the making of prints and/or the development of films or photographic paper, even if the assembling of prints with film sections and the calculation of the cost of customer orders are performed by automatic or semiautomatic equipment. As a rule, the film sections and the prints are fed to a station where an attenedant observes the operation of the apparatus and carries out certain steps. Reference may be had to the commonly owned copending application Ser. No. 669,500 filed Mar. 23, 1976 by Friedrich Hujer et al. Since the length of intervals which are needed for completion of a cycle depends on the length of the interval which is required for completion of the longest step, the output of the apparatus can be increased only if the interval required for completion of the slowest step is reduced, preferably to match the intervals which are required for the completion of the other step or steps. In the case of automatic film processing apparatus, the slowest step is that which involves the assembly of film sections with prints and calculation of the cost of successive transactions. This is due to the fact that the just mentioned steps still involve at least some manual work.

OBJECTS AND SUMMARY OF THE INVENTION

An object of the invention is to provide a fully automatic apparatus for assembly of sections of exposed and developed photographic films with corresponding prints and for packing of such assemblies into containers.

Another object of the invention is to provide an apparatus which is further constructed and assembled for automatic calculation of the cost of each customer order and for automatic application of such information to each container.

A further object of the invention is to provide the apparatus with novel and improved means for controlling and regulating the synchronization of various operations.

An additional object of the invention is to provide the apparatus with a novel and improved evaluating arrangement which can alert the attendant in the event of improper synchronization and/or other malfunctions and can also point out the nature of malfunctions to thus allow for rapid carrying out of necessary corrective steps.

Another object of the invention is to provide an apparatus whose output greatly exceeds the output of heretofore known apparatus and which is not only more reliable than conventional apparatus but also requires less attention and a minimum of skill on the part of an attendant.

An ancillary object of the invention is to provide a novel and improved arrangement of conveyors in the apparatus of the above outlined character.

Another object of the invention is to provide an apparatus which can be coupled or otherwise combined with existing developing machines for photographic films and photographic paper as well as with existing copying machines.

A further object of the invention is to provide an apparatus which can process different types of films and/or different types of prints and can insert related films and prints into any one of a variety of different container types.

The improved apparatus is used for the assembling of developed prints with related exposed and developed photographic customer films which are provided with first and second indicia (e.g., notches or dark spots) respectively denoting successive film frames and the last film frame. Prior to development in a photographic processing laboratory wherein the improved apparatus is used, the exposed customer films are confined (i.e., for shipment, mailing or delivery) in information-bearing envelopes. The prints originally form part of a photographic paper web having third and fourth indicia (e.g., notches or other markers which can be exposed onto the photosensitive layer of the web) respectively denoting successive prints and the last print of a series of prints which are related to a given film (i.e., made in a copying machine by reproducing the images of frames forming part of a customer film).

The apparatus comprises first and second feeding devices which respectively include first and second severing means operative to subdivide developed films into sections (each such section preferably consists of a series of several neighboring film frames) and the web into discrete prints, a third feeding device including a source of a succession of envelopes and a reader or analogous means for automatically decoding the information on successive envelopes and for transmitting corresponding signals to the input means of a computer, conveyor means cooperating at least with the first and second feeding devices to assemble sections of successive films with related prints, a packing unit including a source of empty containers, means for transferring successive assembled film sections and related prints into successive empty containers, and control means including means for operating the first severing means in synchronism with the second severing means.

The first and second severing means respectively comprise means for cutting the films across the frame lines between neighboring film frames in response to predetermined (e.g., successive, fourth, fifth or sixth) first indicia and means for cutting the web across the frame lines between successive prints in response to detection of the third indicia. The first and second feeding devices further respectively include means for terminating the subdivision of film in response to detection of a second indicium and means for terminating subdivision of the web in response to detection of each fourth indicum.

The conveyor means may include a succession of receptacles and means for moving the receptacles seriatim into register with the discharge ends of the first and second feeding devices (and, if desired, also into register with the discharge end of the third feeding device) so that each receptacle which is moved beyond the feeding devices contains a group of film sections and a set of prints (and the corresponding envelope).

The novel features which are considered as characteristic of the invention are set forth in particular in the appended claims. The improved apparatus itself, however, both as to its construction and its mode of operation, together with additional features and advantages thereof, will be best understood upon perusal of the following detailed description of certain specific embodiments with reference to the accompanying drawing.

DESCRIPTION OF THE PREFERRED EMBODIMENTS

Figure 1:
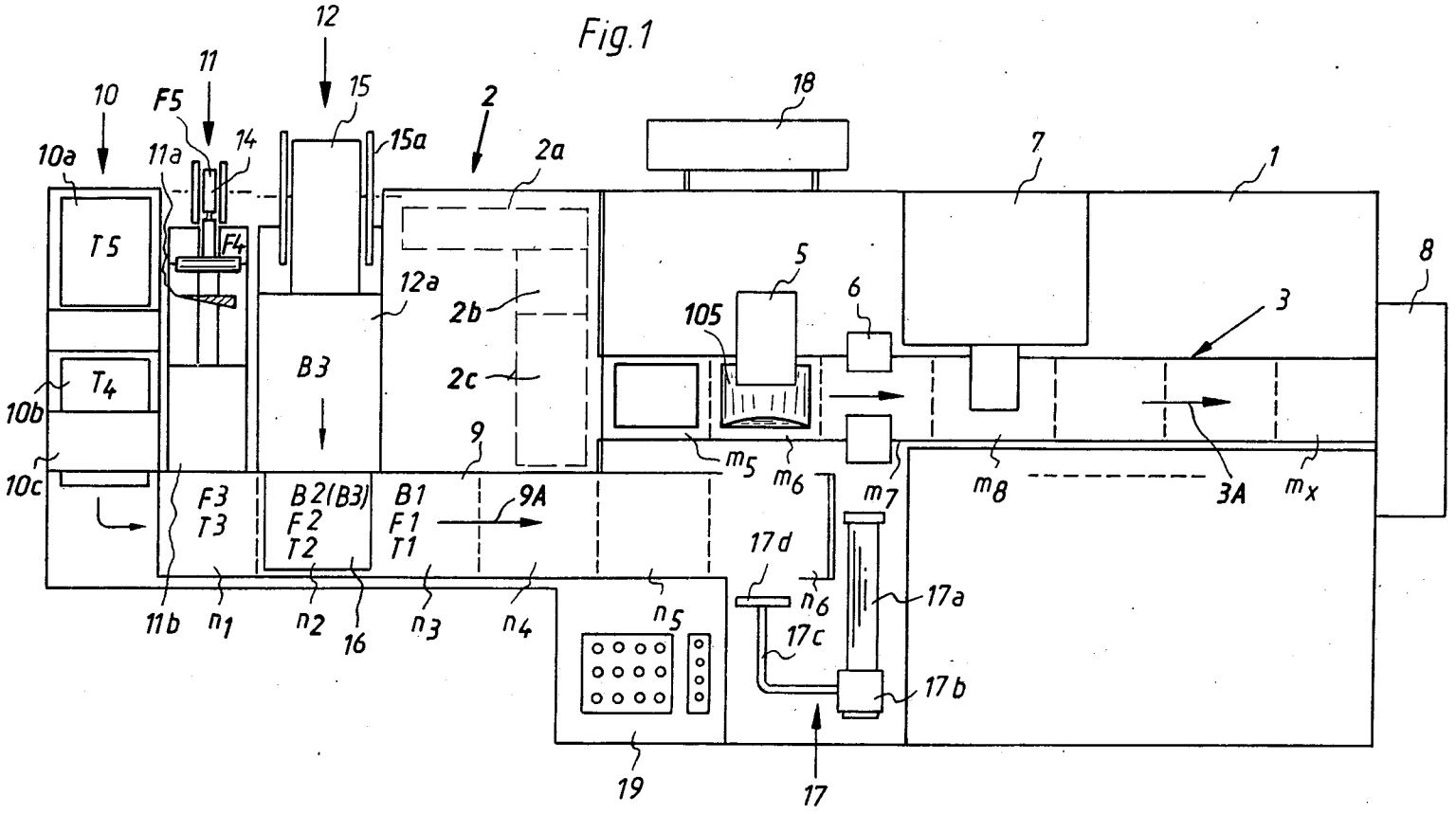
FIG. 1 is a schematic plan view of an apparatus which embodies the invention.

The apparatus which is shown in FIG. 1 comprises a frame or support 1 for several units including a packing unit 2 for the making and/or storage of containers which may constitute cardboard boxes, so-called blister type packs or other suitable containers for film strips, prints and advertising material. For example, the packing unit 2 may include means **2*b* for converting prefabricated cardboard blanks (stored in a magazine 2*a*) into flat packs which are open at one end and each of which is long enough to receive film strips consisting of rows of four, five or six film frames. A transporting system 2*c* of the unit 2 delivers containers to the adjacent rear portion of a conveyor 3 which may comprise one or more endless chains or belts and is operated in stepwise fashion to intermittently advance successive containers along an elongated path indicated by the arrow 3A. The packing unit 2 further comprises a holding device 5 which is adjacent the conveyor 3 and serves to temporarily hold successive open-ended containers in optimum positions for reception of film strips and prints. If the device 2*b* for conversion of prefabricated blanks into erected open-ended containers is omitted, the holding device 5 which maintains successive containers in requisite position for reception of film strips and prints includes means for converting blanks into open-ended containers. The holding device 5 is followed by a closing device 6 which, in turn, is followed by a labelling device 7. Successive filled, closed and labelled containers are fed into a receiving device 8** which can constitute a simple collecting vessel or may be provided with a sorting or classifying mechanism which stacks or otherwise assembles labelled containers in response to detection of predetermined indicia or markers; e.g., the classifying mechanism can group containers which are destined to be picked up or delivered to different dealers in photographic material. The dealers receive orders from customers and the customers pick up the containers from their dealers a given number of days after the delivery of orders.

The labelling device 7 can be installed adjacent to the path 3A downstream of the closing device 6, depending upon whether or not the labels are applied across those sides or ends of containers which are closed by the device 6. The placing of labelling device 7 upstream of the closing device 6 merely necessitates a minor adjustment of the control unit which regulates the sequence of operation of various other units and devices.

The just described packing unit 2, together with its conveyor 3 and devices 5, 6, 7 and 8, constitutes one main component of the improved apparatus. Another main component or unit includes devices which assemble sections of photographic films with the corresponding prints for introduction into empty containers on the conveyor 3. The purpose of the second main component is to bring together sections F of exposed, developed and severed customer films 14 with the corresponding prints B not later than at the assembly station $m_6$ of the conveyor 3 so that the assemblies of film sections F and corresponding prints B can be introduced into the adjacent empty containers on the chain or chains of the conveyor 3 while the containers are held by the device 5 in optimum positions for introduction of film sections and prints into their interior. In addition to film sections and prints, each container can further receive an envelope T which bears information identifying the dealer or customer and is used by the dealer or customer to send the exposed but undeveloped film or films to the processing laboratory.

When the laboratory receives an order, it is normally in the form of an envelope or bag T which contains exposed but undeveloped customer film or films and is provided with information identifying the dealer or the customer, the number of prints to be made of each film frame, the size of prints to be made, other characteristics of the prints (matte, glossy, etc.), and a serial number or order number. When an envelope T arrives at the laboratory, the film or films 14 are removed and such films are then spliced together end-to-end to form a long web which is coiled on a reel and is ready for transport through the developing machine. The envelopes T which contain or carry the pertinent information are stacked or otherwise assembled in the same sequence in which the films 14 are spliced to each other. Proper stacking of envelopes T is particularly important when the films 14 are spliced to each other prior to transport through the developing machine. However, the same procedure is preferably followed if the films 14 are spliced together subsequent to transport through the developing machine. The web of developed films 14 is thereupon caused to pass through the copying machine which makes reproductions of images of all or selected film frames on a web 15 of photographic paper, i.e., the prints B on the web 15 are made in the same sequence in which the corresponding envelopes T are stacked subsequent to removal of exposed but undeveloped films 14. The last frame or the trailing end of each film 14 is provided with a marker or indicium which denotes the end of a customer order, and analogous markers or indicia are applied to the web 15 of exposed photographic paper to facilitate automatic collating of film sections F and corresponding prints B.

The aforementioned second main unit or component of the improved apparatus comprises a second conveyor 9 which serves to move envelopes T, film sections F and prints B along a path indicated by the arrow 9A. The conveyor 9 may comprise one or more endless chains or belts whose upper reaches transport the items T, F and B in parallelism with the direction of transport of containers on the upper reaches of the chains forming part of the conveyor 3. In the illustrated embodiment, the conveyor 9 (which is operated in stepwise fashion, in synchronism with the conveyor 3) receives film sections F upstream of the prints B and downstream of the envelopes T. However, the sequence in which the items T, F and B are delivered to the conveyor 9 can be changed at will without departing from the spirit of the invention. For example, the positions of the loci of delivery of film sections F and prints B can be interchanged.

The second unit or component of the apparatus further comprises a feeding device 10 whose discharge end delivers successive envelopes T to the upstream ends of the upper reaches of chains forming part of the conveyor 9, a feeding device 11 for the film sections F, and a feeding device 12 for the prints B.

Figure 2:
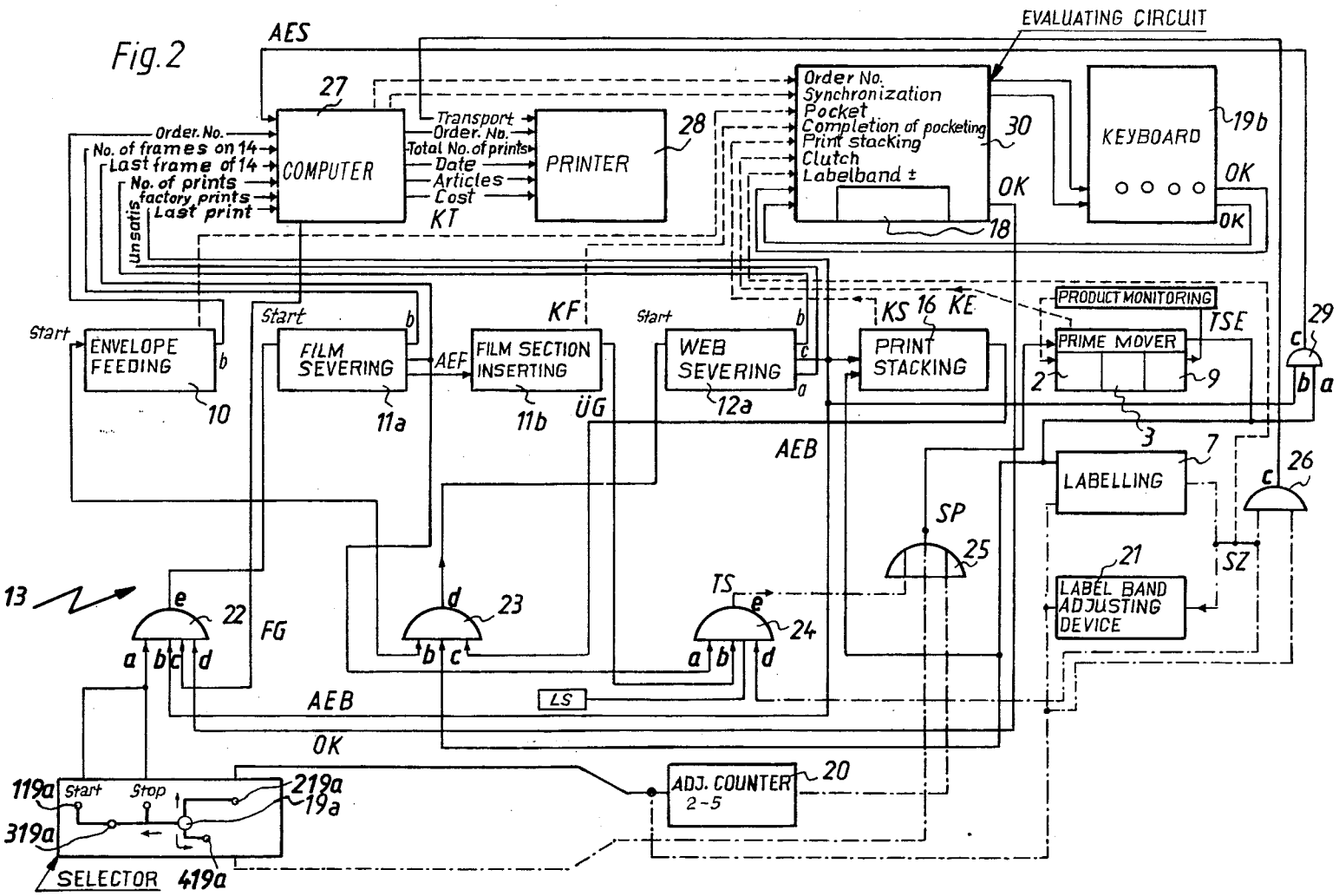
FIG. 2 is a diagrammatic view of the control unit and certain other components of the apparatus.

The feeding device 10 comprises a magazine or hopper 10*a* which stores a supply of envelopes T in the aforementioned order. The hopper 10*a* is followed by an intermediate station 10*b* which precedes an automatic decoding means or reader 10*c* of information on successive envelopes T. The feeding device 10 further comprises a suitable transporting system (e.g., one or more endless belts with entraining means for successive envelopes T) serving to advance envelopes from the magazine 10*a* to the station 10*b*, thereupon into register with the reader 10*c* and finally onto the conveyor 9. The conveyor 9 is assumed to comprise a series of receptacles (e.g., trays) *n* including the receptacles *n*1, *n*2, *n*3, *n*4, *n*5 and *n*6 which are shown in FIG. 1. Such receptacles travel along an endless path and their contents are transferred into the neighboring empty containers 105 on the conveyor 3 when the receptacles reach the position occupied by the receptacle *n*6 of FIG. 1. The transporting system of the feeding device 10 can deliver successive envelopes T into successive rearmost receptacles *n* of the conveyor 9 (see the receptacle *n*1 of FIG. 1). The reader 10*c* decodes the information on successive envelopes T and transmits corresponding signals to a control unit 13 the details of which are shown in FIG. 2. Once the reader 10*c* has completed the decoding of information on the adjacent envelope T, the envelope has fulfilled its purpose and can be transported to storage or returned to the dealer or customer. As mentioned above, the information which is decoded by the reader 10*c* includes indications identifying the dealer and/or customer. As a rule, the envelopes T will be stored in the processing laboratory, at least for a certain period of time, in order to enable the attendants to determine, at a later date, whether or not an order has been received from the customer or dealer and/or to determine whether or not the number and/or nature of prints furnished to the dealer or customer conforms to instructions on the respective envelope. It is assumed that the apparatus of FIG. 1 introduces envelopes T into successive empty containers on the conveyor 3 so that the envelopes are ultimately returned to the customer.

The feeding device 11 for film sections F comprises an automatic severing mechanism 11*a* which subdivides successive exposed and developed photographic films 14 into sections F of selected length (as mentioned above, each section may consist of a row of four, five or six film frames). The manner in which the films 14 are arrested at necessary intervals to place the frame lines between successive film sections F into register with the mobile knife of the severing mechanism 11*a* is known in the art. As a rule, a marginal portion or the rear side of each film 14 is provided with indicia denoting successive frames; such indicia are monitored by a suitable detector which transmits signals to a counter controlling the transport of film 14 in a direction toward the conveyor 9. When the counter receives a preselected number of signals, the film 14 is arrested and the severing device 11*a* is actuated to separate the preceding section F from the next-following section. Furthermore, the last frame or the trailing end of each film 14 carries a readily detectable indicium or marker which is detected by a suitable monitoring device, and the resulting signal is used to transport the corresponding set of film sections F to the receptale (*n*2 in FIG. 1) which is in register with the feeding device 11. Of course, the feeding device 11 delivers a group of preferably stacked film sections F into that receptacle *n* of the conveyor 9 which already contains the corresponding envelope T. In other words, and assuming that the corresponding envelope T has been admitted into the receptacle *n*1 of FIG. 1, the group of film sections F belonging to the customer who has delivered or sent the envelope in the receptacle *n*1 to a dealer or directly to the processing laboratory will leave the feeding device 11 when the recepacle *n*1 moves to the position occupied in FIG. 1 by the receptacle *n*2. The feeding device 11 further comprises an inserting mechanism 11*b* which follows the severing mechanism 11*a* and contains a supply of pockets (e.g., simple envelopes made of paper or synthetic plastic material) each of which receives a group of related film sections F. Such pockets are thereupon delivered into successive receptacles *n* of the conveyor 9 to join the corresponding envelopes T. The subdivision of a film 14 into sections F, the introduction of related sections F into a pocket, and the transfer of such pocket into the adjacent receptacle *n* of the conveyor 9 is completed within one and the same cycle, i.e., during one and the same interval of dwell of the receptacle *n* (which contains the associated envelope T) in register with the discharge end of the feeding device 11.

The transporting system of the feeding device 11 may comprise one or more belts or chains which advance film sections F from the severing mechanism 11*a* to the inserting mechanism 11*b* and thereupon advance pockets (containing groups of film sections F) to the adjacent station of the conveyor 9.

The feeding device 12 for prints B comprises a severing mechanism 12*a* which cuts the web 15 of exposed and developed photographic paper midway across successive frame lines. The severing mechanism 12*a* is actuated in response to signals transmitted by a detector which monitors the aforementioned indicia or markers at the rear side of the web 15; each such indicium denotes a discrete print. The severing of a succession of prints B is terminated when the same detector or another detector detects a different marker or indicium denoting the last print of an order. The severing mechanism 12*a* is followed by a print collecting or stacking mechanism 16 which is installed at a level above the adjacent receptacle *n* of the conveyor 9 (see the receptacle *n*2 in FIG. 1). The transporting system which advances prints B from the severing mechanism 12*a* to the stacking mechanism 16 may comprise one or more endless belts or analogous conveying elements. A full stack or set of prints B is dumped or otherwise transferred into the adjacent receptacle (*n*2) before the conveyor 9 is set in motion to transport the receptacle to the next station (occupied by the receptacle *n*3 of FIG. 1). The severing of a web 15 to yield a stack or set of prints B belonging to one and the same customer and the determination whether or not such prints belong to the customer whose film sections F are about to reach the discharge end of the feeding device 12 take place during a single cycle of operation of the apparatus. In order to allow the severing mechanism 11*a* to complete the subdivision of a given film 14 into sections F, the dumping of the corresponding stack or set of prints B into the adjacent receptacle *n* can be effected during the next-following cycle.

The assemblies of envelopes T, film sections F and prints B which advance beyond the stacking mechanism 16 of the feeding device 12 are transported past one or more stations (see the receptacles *n*3–*n*5 of FIG. 1) where the assemblies are examined for completeness (as well as whether or not the envelopes are assembled with corresponding film sections and prints) and/or where the receptacles receive one or more items of advertising material or the like (e.g., advertising material and/or blank envelopes for sending or delivery of next exposed but undeveloped photographic roll films 14 to a dealer or directly to the processing laboratory).

The assembly station (where envelopes, film sections, prints and advertising literature, etc. are introduced into empty containers) is in register with the foremost receptacle (*n*6) of the conveyor 9. The transfer unit 17 which introduces collated items into successive empty containers comprises at least one reciprocable transfer element or pusher 17*d* which can be moved transversely across the interior of the adjacent receptacle (*n*6) to introduce the contents of such receptacle into the empty container which is held by the device 5 at the station *m*6 of the conveyor 3. In order to simplify the transfer of collated items into successive empty containers, the upper reaches of the conveyors 3 and 9 are preferably located in a common plane which may but need not be horizontal. The transfer unit 17 further comprises a guide 17*a* which extends at right angles to the direction of movement of the conveyors 3 and 9 and supports a slidable motor-driven carriage 17*b* for an arm 17*c* of the pusher 17*d*. The means for reciprocating the carriage 17*b* along the guide 17*a* may comprise a double-acting hydraulic or pneumatic cylinder and piston unit, a rack and pinion drive or a cable which is trained over pulleys one of which is driven by a reversible motor.

The apparatus of FIG. 1 further comprises display board 18 with a number of fields which are illuminated in response to transmission of error signals denoting malfunctioning of various units, devices and/or mechanisms so that an attendant can determine, at a glance, the locus of malfunction and can immediately carry out the necessary corrective measures. For example, the illuminated signals on the display board 18 can denote the absence of envelopes, film sections and/or prints in the receptacles of the conveyor 9, the absence of containers on the conveyor 3, the malfunctioning of motor means for reciprocating the carriage 17*b*, the absence of envelopes T in the hopper 10*a*, the absence of advertising material in the magazine or magazines between the transfer unit 17 and the feeding device 12, and/or other factors which warrant temporary stoppage of the apparatus or the undertaking of corrective measures.

A control panel 19 is adjacent to the path of movement of receptacles *n* ahead of the transfer unit 17. The knobs, buttons or other suitable manually actuatable elements on the control panel 19 can be reached by an attendant to initiate the transmission of signals which serve to eliminate certain causes of malfunction and/or to effect stoppage or renewed starting of the apparatus. The placing of control panel 19 adjacent the path 9A is advisable and advantageous because the attendant standing or sitting next to the conveyor 9 can inspect the collating operation as well as the transfer of collated items into successive containers on the conveyor 3.

The operation of the heretofore described parts of the apparatus is as follows.

During each cycle, the prime mover means for the conveyors 3 and 9 advances these conveyors by a step, i.e., the receptacle *n*1 moves to the position previously occupied by the receptacle *n*2, etc., and the container which was held by the device 5 moves into register with the closing device 6, etc. A customer order is introduced into the apparatus and a completed customer order enters the receiving device 8 during each cycle. Thus, the transporting system of the feeding device 10 removes a discrete envelope T from the array of envelopes in the hopper 10*a* and moves the separated envelope to a position in which the envelope can be detected by a detector which, in the absence of an envelope, transmits a signal to the corresponding field of the display board 18. The hopper 10*a* is assumed to be designed in such a way that the envelopes which are stored therein are removed from below, i.e., the lowermost envelope of the array or stack is moved to a position to be inspected by the just discussed detector. The previously separated and detected envelope (T4) is held at the intermediate station 10*b*. When a cycle begins, the envelope (T4) which was held at the station 10*b* is advanced to a position of alignement with the reader 10c which decodes the information on such envelope and transmits signals denoting the decoded information to the control unit 13 (and more particularly to a computer 27 shown in FIG. 2). The thus examined envelope (T4) is expelled from the feeding device 10 (e.g., in a direction to the left, as viewed in FIG. 1) or is advanced into the rearmost receptacle (*n*1) of the conveyor 9. A fresh envelope is advanced from the hopper 10a to the intermediate station 10b whenever an envelope is advanced from the station 10b to a position of register with the reader 10c.

The exposed and developed film 14 which belongs into or is to be returned with the envelope in the receptacle *n*1 is severed by the severing mechanism 11a, introduced into a pocket by inserting mechanism 11b and transported into the receptacle *n*1 before the conveyor 9 is advanced by a step.

The corresponding portion of the web 15 of exposed and developed photographic paper is subdivided by the severing mechanism 12a and is transferred into the stacking mechanism 16 during the same cycle. The outlet of the mechanism 16 is blocked so that it can dump its contents into the adjacent receptacle (*n*1) only upon completion of the next stepwise advancement of the conveyor 9. The dumping of a stack or set of prints B can take place only upon completion of an inspection for the purpose of determining whether or not the film sections F in the receptacle which is to move into register with the stacking mechanism 16 belong to the customer who is to receive the prints B held at a level above the path of the receptacles *n*. The stacking mechanism 16 may comprise a pivotable bottom wall which is tilted in response to a signal, and such signal is furnished upon completion of comparison of film sections in the receptacle *n*1 with prints B in the stacking mechanism 16. The inspection preferably includes a determination of the number of markers or indicia on the film sections F (or on the corresponding film 14) and of the number of prints B in the stacking mechanism 16. A stop signal is generated when the number of prints deviates from the total number of detected markers (such markers denote the number of film frames on the respective film).

The receptacle *n*3 of the conveyor 9 contains a complete assembly of collated items which are to be introduced into a container on the conveyor 3 (it being understood that the apparatus can also admit one or more pamphlets or other printed matter into successive receptacles *n* in the space between the discharge end of the feeding device 12 and the assembly station *m*6 in front of the pusher 17d). The complete set of items is transferred into the adjacent empty container which is held by the device 5, and such container is thereupon transported, in stepwise fashion, into register with the closing device 6, labelling device 7 and on toward and into the receiving device 8. The corresponding stations of the conveyor 3 are shown at *m*6, *m*7, and *m*8. The station *m*5 precedes the holding device 5 and the station $m_x$ immediately precedes the receiving device 8. As mentioned above, the receiving device 8 may constitute a simple collecting vessel or it may be equipped with a mechanism for sorting or classifying of containers according to their destination, e.g., according to the names or code numbers of dealers.

The additional reference characters which are shown in FIG. 1 are intended to facilitate the understanding of operation of the improved apparatus. Thus, the receptacle *n*3 of the conveyor 9 contains an envelope T1, the corresponding pocket with film sections F1 and the corresponding stack of prints B1. These items together constitute the collated material of a first customer order. The receptacle *n*2 of the conveyor 9 contains the items T2, F2 and B2 of tbe next-following (second) customer order. The prints B2 were dumped into the receptacle *n*2 at the start of the corresponding cycle so that the stacking mechanism 16 is ready to receive prints which are obtained in response to subdivision of the next portion of the web 15 of photographic paper by the severing mechanism 12a. The prints B3 of the next-following (third) customer order are still integral parts of the web 15 on a real 15a. The film sections F5 of the fifth customer order are still integral parts of the respective (unsevered) film 14 and the film which precedes the just mentioned (unsevered) film 14 is in the process of being subdivided into sections F4 by the severing mechanism 11a of the feeding device 11. The envelope T3 (of the third customer order) is located in the receptacle *n*1. During the corresponding cycle, the receptacle *n*1 receives the film sections F3 which were obtained upon subdivision of a customer film 14 that was originally confined in the envelope T3. The envelopes T4 and T5 which are to form part of the fourth and fifth customer orders are still located in the feeding device 10. The envelope T5 is in a position in which it can be detected by the aforementioned monitoring means and is preferably also observable by the attendant at the control panel 19.

The control unit 13 of FIG. 2 regulates the assembly of items T, F and B, the introduction of collated items T1, F1, B1; T2, F2, B2; etc. into containers, the application of printed matter to labels, the attachment of labels to corresponding containers, and the operation of prime mover means for the unit 2, conveyors 3, 9 and transporting systems of feeding devices 10–12. A feature of the control unit 13 is that, during normal operation of the apparatus, each and every station of the conveyor 9 (receptacles *n*1 to *n*6) and each and every station *m*6–$m_x$ of the conveyor 13 is occupied, either by a group of film sections F, by film sections F and associated prints B, by empty containers or by filled containers. This guarantees that film sections will be assembled with prints as well as that the assemblies of prints and film sections will be introduced into empty containers and that filled containers will be provided with labels. If a station of the conveyor 3 and/or 9 is unoccupied, the apparatus is arrested without delay. Furthermore, the apparatus is arrested in response to development of malfunctions, for example, when the container which is moved toward or held by the device 5 at the station *m*6 is oriented in such a way that it cannot receive an assembly of related items.

The mode of operation of the apparatus deviates from the just discussed normal mode during a certain interval following the starting and during a certain interval preceding the stoppage of apparatus. Therefore, the control unit 13 is designed to establish a first special mode of operation immediately after starting and a second special mode of operation during the aforementioned interval preceding the stoppage of the apparatus. In the course of such special modes of operation, the application of labels is regulated accordingly, i.e., in a manner to insure that each and every filled container which reaches the station *m*8 is provided with a label having printed matter which is indicative of the contents of such container.

During the interval which immediately follows the start signal for the prime mover means for the unit 2, conveyors 3, 9 and transporting systems of feeding devices 10–12, the path defined by the transporting system 2*c* of the unit 2 is filled with empty containers all the way to and including the station *m*6, and the looped band (not shown) of labels is automatically adjusted so that the length of the loop equals a predetermined optimum length for the application of printed matter. During the interval immediately preceding stoppage of the apparatus, the packing operation (unit 2) continues in spite of the fact that a progressively increasing number of stations on the conveyor 9 will be unoccupied. Actual stoppage of the apparatus takes place when the last filled, closed and labelled container reaches the receiving device 8.

The control panel 19 includes a selector 19*a* (e.g., a multi-position switch) which is movable between a plurality of positions including a "start" position 119*a* in which the prime mover means is energized and a second position 219*a* in which a clutch connecting the prime mover means with the mobile parts of the transporting system 2*c* in the unit 2 is engaged. This results in automatic introduction of a predetermined number (e.g., four) of empty containers into the path leading to the station *m*6 on the conveyor 3. The number of empty containers depends on the distance between the stack of container blanks in the magazine 2*a* of the unit 2 and the station *m*6. Such number can be selected by appropriate adjustment of a counter 20. The counter 20 is adjusted by insertion of an appropriate information-bearing card into the control unit 13. During introduction of empty containers into the path between the stack of container blanks (magazine 2*a*) and the station *m*6, (i.e., in the position 219*a* of the selector 19*a*), the length of the aforementioned looped label band is automatically adjusted with the assistance from two monitoring devices one of which transmits a signal when the loop is too long and the other of which transmits a signal when the loop is too short. Such monitoring devices form part of a label band adjusting device or circuit 21 in the control unit 13. The circuit 21 further determines whether or not the label which is about to be provided with printed matter is properly positioned relative to the corresponding assembly of film sections F and prints B. If the loop is too short, the label band is advanced and lengthened during each stage of intermittent movement of conveyors 3 and 9. If the looped label band is too long, the signal from the adjusting device 21 prevents the lengthening of label band until the length of the band is reduced in response ro removal of one or more labels. As a rule, the label band will include a flexible carrier for a row of discrete labels which are separable therefrom and one side of each of which is coated with a layer of a suitable pressure- or heat-activatable adhesive.

When the just discussed interval (immediately following shifting of the selector 19*a* to the second position 219*a* has elapsed, the selector 19*a* is shifted to the position 319*a* in which it remains during normal operation of the apparatus. The label band adjusting circuit 21 remains operative in the position 319*a* of the selector 19*a*. The actuation of conveyors 3 and 9 is then taken over by a follow-up system of the control unit 13.

Prior to stoppage of the apparatus, the selector 19*a* is moved to the position 419*a* which can be called "winding up" or "runout" position. The film sections F and prints B which have been turned out by the feeding devices 11 and 12 prior to movement of the selector 19*a* to the position 419*a* are transported through the apparatus, i.e., such film sections and prints are assembled with each other and introduced into empty containers which are thereupon closed, labelled and introduced into the receiving device 8. The delivery of containers to the station *m*6 is terminated in automatic response to transfer of the last assembly of prints and film sections by the pusher 17*d* but the conveyor 3 continues to advance in stepwise fashion in order to introduce each and every filled container into the receiving device 8. While the selector 19*a* is held in the position 419*a*, the labelling device 7 is operated in synchronism with stepwise movements of the conveyor 3 in response to signals from that monitoring device of the label band adjusting circuit 21 which furnishes signals when the loop is too short.

The aforementioned follow-up system of the control unit 13 comprises five logic circuits or elements 22, 23, 24, 25 and 26. The circuits 22–24 and 26 are AND-gates, and the circuit 25 is an OR-gate. A cycle can be started when each of the four inputs *a* to *d* of the gate 22 receives a signal. The input *a* receives a signal from the selector 19*a*. When the output *e* of the gate 22 transmits a signal, the severing mechanisms 11*a* and 12*a* are started simultaneously provided that the output *d* of the gate 23 also transmits a signal. This takes place when the gate 23 receives two signals, namely a first signal (at the input *c*) which denotes that the print stacking mechanism 16 is empty and a second signal TSE (at the input *b*) which denotes that a stepwise advance of the conveyor 9 has been completed, i.e., that the conveyor 9 is temporarily arrested. When the severing of a customer film 14 is completed, detection of the aforementioned marker or indicium which denotes the last frame of a customer film results in the transmission of a signal AEF. Such detection is performed by a monitoring device in or at the severing mechanism 11*a*, and the transmission of signal AEF results in actuation of a photoelectric cell LS which is adjacent to the system which transports pockets to the inserting mechanism 11*b* in the feeding device 11. When the transport of a pocket is completed, the mechanism 11*b* transmits a signal UG to the input *b* of the AND-gate 24. The output *e* of the gate 24 transmits a signal TS if the input *a* of this gate receives the signal AEF and the input *d* of the gate 24 receives a signal SZ which denotes the condition of the looped label band. The signal TS is then transmitted to the OR-gate 25 which transmits a signal SP resulting in starting of the conveyor 3, conveyor 9 and continued operation of the packing unit 2. When a stepwise advance of transporting system 2*c* in the unit 2 and of conveyors 3 and 9 is completed, the stacking mechanism 16 is actuated in response to signals TSE and AEB so that the collected prints are dumped into the adjacent receptacle (*n*2) of the conveyor 9. The signal AEB is furnished by the severing mechanism 12*a* and denotes the last print B of a customer order. In order that the conveyors 3, 9 and the transporting system 2*c* of the unit 2 may advance again, the four inputs *a–d* of the AND-gate 22 must receive signals as follows: A first signal must be transmitted to the input *a* by the selector 19*a*. The input *b* of the gate 22 must receive a signal AEB which denotes the end of an order, i.e., the last print B of a series of prints belonging to a customer. The input *d* of the gate 22 must receive a signal OK which is transmitted by an evaluating circuit 30 of the control unit 13 and denotes that the prints are associated with related film sections. Finally, a fourth signal FG at the input *c* of the gate 22 must indicate that the computing operation (by 27) for the application of appropriate printed matter to a label has been completed. The output *e* of the gate 22 then transmits a signal which causes the advancement of an envelope T from the station 10*b* into register with the decoding means or reader 10*c* of the feeding device 10. The station 10*b* receives successive envelopes T independently of transmission of signals by the output *e* of the gate 22.

While the conveyors 3, 9 are in motion, the labelling device 7 receives a signal to apply a freshly imprinted label to the container at the station *m*8 when the conveyor 3 comes to a halt. As mentioned above, the operation of the labelling device 7 is monitored by the adjusting device 21. When the looped band of labels is unsatisfactory, the device 21 transmits a signal to the gate 25 which blocks the movement of the conveyors.

The apparatus further comprises means for calculating the cost of each transaction and means for applying the pertinent information to successive labels. Moreover, the just discussed means apply to each label additional information, such as the name or code of the dealer or customer. The calculating means comprises the computer 27 and the information applying means includes a printer 28. The computer 27 receives signals primarily from the feeding devices 10 to 12. Such signals include the information which is decoded by the reader 10*c* of the feeding device 10. As shown in FIG. 2, the output *b* of the reader 10*c* in the feeding device 10 transmits to the computer 27 signals denoting the order numbers on successive envelopes T. The output *b* of the severing mechanism 11*a* in the feeding device 11 transmits signals which denote the number of film frames (negatives) on a film 14 belonging to a customer (such signals are produced by the means which monitors the number of notches or other types of indicia on the films 14). Moreover, the feeding device 11 transmits signals denoting the last frames of successive films 14. The outputs *b* and *c* of severing mechanism 12*a* of the feeding device 12 transmit to the computer 27 two types of signals, namely, a signal (output *b*) for each print B belonging to a given order (unsatisfactory prints are not included, see the output *d* of 12*a*) and a signal (output *c*) denoting the last print belonging to an order. The computer 27 further receives signals AES denoting the completion of an order. Such signals are transmitted by the output *c* of an AND-gate 29 when the inputs *a* and *b* of this gate respectively receive the signals TSE (completion of stepwise advance of conveyors 3, 9) and AEB (last print of a customer order). The computer 27 evaluates the information and, if the result of evaluation is positive, its outputs transmit signals to the printer 28. As shown in FIG. 2, the printer 28 receives signals denoting the order number, the total number of prints, the cost of the transaction, the date of completion of order and the nature of items.

The computer 27 may be further connected with a signal storing unit (not shown) which contains information that is specific to customers and/or to the processed material. During the aforementioned interval immediately following starting of the apparatus (the selector 19*a* then assumes the position 219*a*), the printer 28 receives start signals (one for each stepwise advance of the conveyor 3) from the output *c* of the AND-gate 26 so that the labelling device 7 can advance the looped band in stepwise fashion.

The aforementioned display board 18 forms part of or is associated with the evaluating circuit 30 which receives various signals from the feeding devices 10, 11 and 12, such as the signal KT from the feeding device 10, the signal KF from the inserting mechanism 11*b* of the device 11, the signal KS from the print stacking mechanism 16 and the signal SZ from the adjusting device 21. The evaluating circuit 30 further receives signals KE which are indicative of different stages of container processing in the unit 2, such as erection of a container (conversion of a prefabricated blank into a container), the number of containers in the unit 2, the closing or absence of closing of filled containers by the device 6, the orientation of a container at the station *m*6 and/or the transfer or absence of transfer of assembled prints and film sections into a container at the station *m*6. Still further, the evaluating circuit 30 is connected with the computer 27 which latter can transmit two types of signals, namely signals denoting improper order numbers and signals denoting absence of synchronization.

The computer 27 transmits a signal which denotes an improper order number when the order number which is decoded by the reader 10*c* does not correspond to the "3 out of 5" code. A signal denoting the absence of synchronization is transmitted when the number of indicia or notches on a film 14 does not match the number of corresponding prints. The computer 27 monitors such information continuously and transmits a stop signal when the evaluation of information results in detection of improper synchronization or of the presence of an unsatisfactory order number. This insures rapid elimination of unsatisfactory synchronization. The just discussed error signals are further transmitted to a keyboard 19*b* of the panel 19. By actuating selected knobs on the keyboard 19*b*, an attendant can eliminate the causes of error signals. When the cause or causes of malfunction are eliminated, the output of the keyboard 19*b* transmits "OK" signals to the evaluating circuit 30.

The fields of the board 18 indicate all types of disturbances and/or errors. The error signals are of two types, namely, those denoting malfunctions detected in response to timely spaced checks and those denoting malfunctions as they arise. The means for detecting first types of malfunctions includes time delay elements which furnish signals after elapse of preselected maximum permissible intervals. The second types of malfunctions result in immediate generation of signals at the very moment of malfunction. All such signals are erased by elimination of the cause or by actuation of knobs on the keyboard 19*b*. The elimination of defect signals results in transmission of an OK signal from the evaluating circuit 30 to the corresponding input *d* of the AND-gate 22 so that the apparatus is again ready for operation.

An important advantage of the apparatus is that the control unit 13 invariably insures proper assembly of related items F and B or T, F and B. The entire apparatus can be supervised and serviced by a single person, and such person must intercede only when the display board 18 of the evaluating circuit 30 furnishes visible signals denoting that a corrective measure is necessary.

The improved apparatus is susceptible of many additional modifications. As mentioned above, the order in which the discharge ends of feeding devices 10–12 supply the respective items to the conveyor 9 can be altered at will. Also, the labelling device 7 can be installed ahead of the closing device 6. The number of stations (receptacles *n*1–*n*6) on the conveyor 9 and/or of stations on the conveyor 3 can be increased or reduced.

Still further, the severing mechanism 11*a* in the feeding device 11 can be provided or associated with a second decoding means or reader which compares the information (identifying the dealer and/or customer) encoded at the leaders and/or trailing ends of films 14 with the information which is decoded by the reader 10*c*.

An envelope feeding device similar to that (10) which can be used in the apparatus of the present invention is disclosed in German Utility Model No. 7,610,153. Commonly owned U.S. Pats. Nos. 3,777,960 and 3,787,702 respectively disclose film and print feeding devices similar to those shown at 11 and 12.

An erected container 105 is shown in FIG. 1 in the holding device 5.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of our contribution to the art and, therefore, such adaptations should and are intended to be comprehended within the meaning and range of equivalence of the claims.

What is claimed is:

1. Apparatus for assembling developed prints with related developed films which are provided with first and second indicia respectively denoting successive film frames and the last film frame and which, prior to development thereof, are confined in information-bearing envelopes, comprising first and second feeding devices respectively including first and second severing means operative to subdivide developed films into sections and a web of prints into discrete prints, said web having third and fourth indicia respectively denoting successive prints and the last one of a series of prints which are related to a given film; a third feeding device including a source of a succession of information-bearing envelopes and means for decoding the information on successive envelopes and for transmitting corresponding signals; conveyor means cooperating at least with said first and second feeding devices to assemble sections of successive films with related prints; a packing unit including a source of empty containers; means for transferring successive assembled film sections and related prints into successive containers; control means including means for operating said first severing means in synchronism with said second severing means; and computer means having input means for said signals.

2. Apparatus as defined in claim 1, wherein said first and second severing means respectively comprise means for cutting said films across the frame lines between neighboring film frames in response to detection of predetermined first indicia and means for cutting said web across the frame lines between successive prints in response to detection of said third indicia.

3. Apparatus as defined in claim 2, wherein said first and second feeding devices respectively include means for terminating the subdivision of a film in response to detection of a second indicium and means for terminating the subdivision of said web in response to detection of a fourth indicium.

4. Apparatus as defined in claim 1, wherein said first and second feeding devices respectively have first and second discharge ends and said conveyor means includes a succession of receptacles and means for moving said receptacles seriatim into register with said discharge ends so that each receptacle contains a group of film sections and a set of prints upon movement beyond said discharge ends.

5. Apparatus as defined in claim 4, wherein said first feeding device further comprises means for inserting groups of film sections into discrete pockets upstream of the respective discharge end.

6. Apparatus as defined in claim 4, wherein said second feeding device further comprises means for stacking said sets of prints upstream of the respective discharge end.

7. Apparatus as defined in claim 4, wherein said control means includes means for monitoring the receptacles downstream of said discharge ends for the presence of groups of film sections and related sets of prints.

8. Apparatus as defined in claim 4, wherein said third feeding device has a discharge end adjacent to said conveyor means and said third feeding device further comprises means for transporting successive envelopes from said decoding means into successive receptacles of said conveyor means so that a receptacle which is advanced beyond said feeding devices contains an envelope, the corresponding group of film sections and the set of related prints.

9. Apparatus as defined in claim 1, wherein said packing unit further comprises second conveyor means arranged to move successive empty containers along a predetermined path a portion of which is adjacent to a portion of said first mentioned conveyor means downstream of said first and second feeding devices, said transferring means including at least one transfer element operable to transfer successive groups of film sections and successive sets of related prints from said portion of said first mentioned conveyor means into successive empty containers in said portion of said second conveyor means.

10. Apparatus as defined in claim 9, wherein said transfer element is a reciprocable pusher.

11. Apparatus as defined in claim 8, wherein said succession of receptacles of said first mentioned conveyor means form a row of receptacles including a foremost receptacle, said transfer element being operative to transfer groups of film sections and set of prints from the foremost receptacle of said row.

12. Apparatus as defined in claim 9, wherein said packing unit further comprises means for manipulating containers on said second conveyor means downstream of said transferring means.

13. Apparatus as defined in claim 12, wherein said manipulating means comprises a container closing device.

14. Apparatus as defined in claim 12, wherein said manipulating means comprises a device which applies labels to successive containers.

15. Apparatus as defined in claim 9, further comprising means for receiving containers from said second conveyor means.

16. Apparatus as defined in claim 9, wherein said source of containers includes a magazine for a supply of container blanks and said packing unit further comprises means for converting successive container blanks into open empty containers between said magazine and said second conveyor means.

17. Apparatus as defined in claim 9, wherein said source of containers comprises a magazine arranged to store a supply of open empty containers and means for transporting open empty containers from said magazine to said second conveyor means.

18. Apparatus as defined in claim 1, wherein said packing unit further comprises means for applying labels to loaded containers, said first and second severing means respectively comprising first and second means for detecting said first and second and said third and fourth indicia and for generating additional signals on detection of such indicia, said computer means further having additional inputs for said additional signals and output means for transmission of modified signals, and further comprising printer means responsive to said modified signals to apply pertinent data to said labels.

19. Apparatus as defined in claim 18, wherein said data include the order numbers of the respective envelopes, the numbers of film frames and the numbers of prints in the corresponding containers.

20. Apparatus as defined in claim 18, wherein said data include the cost of the work involved in developing the films and in making of related prints.

21. Apparatus as defined in claim 18, wherein said data include the dates of filling the respective containers and the nature of prints.

22. Apparatus as defined in claim 1, wherein said computer means has at least one output for transmission of error signals and further comprising evaluating means having input means for said error signals and display means for furnishing visible indications of said error signals.

23. Apparatus as defined in claim 22, wherein said error signals denote the absence of identity of the number of film frames and the number of related prints.

24. Apparatus as defined in claim 22, wherein said evaluating means comprises additional input means for additional error signals and further comprising means for transmitting said additional error signals in response to malfunctioning of certain of said feeding devices, conveyor means and packing unit.

25. Apparatus as defined in claim 22, wherein said information includes an order number and said error signals denote the absence of appropriate order number on an envelope which is scanned by said decoding means.

26. Apparatus as defined in claim 22, wherein said evaluating means has output means for transmission of signals denoting the absence of errors and effecting the operation of said severing means.

27. Apparatus as defined in claim 26, further comprising a keyboard including means for generating signals which effect the operation of said severing means.

28. Apparatus as defined in claim 26, further comprising means for interrupting the operation of said severing means in response to and during the transmission of said error signals.

29. Apparatus as defined in claim 1, wherein said control means comprises a follow-up control system including a first logic element having an output for transmission of first signals which start said first and third feeding devices in response to reception of signals from said computer means, from a selector of said control means, from said second severing means on detection of a fourth indicium and a signal denoting the absence of errors in operation of components of the apparatus.

30. Apparatus as defined in claim 29, wherein said first feeding device includes means for inserting related film sections into discrete pockets in response to detection of a second indicium by said first severing means and said system further includes a second logic element having an output for transmission of second signals which start said second severing means on reception of a signal denoting temporary stoppage of said conveyor means and a signal denoting completed accumulation of a set of related prints.

31. Apparatus as defined in claim 30, wherein said second feeding device comprises means for collecting prints made by copying film frames forming part of a given film and said system further comprises a third logic element having an output for transmission of a third signal which starts said collecting means in response to reception of a signal denoting temporary stoppage of said conveyor means and a signal denoting the detection of a fourth indicium by said second severing means.

32. Apparatus as defined in claim 31, further comprising prime mover means for said conveyor means and said packing unit, said system including a fourth logic element having an output for transmission of signals which start said conveyor means in response to reception of a signal denoting the detection of a second indicium by said first severing means, of a signal denoting the completion of collection of prints by said collecting means, of a signal denoting satisfactory length of a band of labels to be applied to successive loaded containers, and of a signal denoting the detection of a series of related film sections.

33. Apparatus as defined in claim 32, further comprising a printer arranged to apply printed matter to successive labels of said band in response to signals furnished by said computer means in response to reception of a signal denoting temporary stoppage of said conveyor means and a signal furnished by said second severing means on detection of a fourth indicium.

34. Apparatus as defined in claim 33, wherein said system includes a further logic element having an output which transmits to said computer means one of said two last mentioned signals.

35. Apparatus as defined in claim 34, wherein said packing unit further comprises a device for applying printed labels to successive loaded containers in response to reception of a signal denoting temporary stoppage of said conveyor means, a signal denoting idleness of said printer, and a signal denoting satisfactory length of said band.

36. Apparatus as defined in claim 35, further comprising means for blocking the operation of said label applying means while said conveyor means is in motion.

37. Apparatus as defined in claim 36, wherein said system further comprises a logic element having an output for transmission of additional signals which start said conveyor means in response to reception of a third signal, of a signal denoting the number of ready empty containers in said packing unit, and of a signal from a selector of said control means.

* * * * *